US006475973B1

(12) United States Patent
Mondin

(10) Patent No.: US 6,475,973 B1
(45) Date of Patent: Nov. 5, 2002

(54) DUAL PHASE CLEANING COMPOSITION

(75) Inventor: Myriam Mondin, Seraing (BE)

(73) Assignee: Colgate-Palmolive Corp, Piscataway, NY (US)

( * ) Notice: Subject to any disclaimer, the term of this patent is extended or adjusted under 35 U.S.C. 154(b) by 178 days.

(21) Appl. No.: 09/612,585

(22) Filed: Jul. 7, 2000

(51) Int. Cl.[7] ..... C11D 17/00

(52) U.S. Cl. ..... 510/417; 510/224; 510/284; 510/406; 510/444; 510/446

(58) Field of Search ..... 510/444, 446, 510/417, 406, 284, 224; 134/22.19

(56) References Cited

U.S. PATENT DOCUMENTS 6,288,015 B1 * 9/2001 Moeller et al.

* cited by examiner

*Primary Examiner*—Gregory E. Webb
(74) *Attorney, Agent, or Firm*—Richard E. Nanfeldt

(57) ABSTRACT

The present invention relates to a two phase cleaning composition containing a nonionic surfactant, a zwitterionic and/or anionic surfactant, a water insoluble organic compound, perfume, glycol ether and water.

13 Claims, No Drawings

DUAL PHASE CLEANING COMPOSITION

BACKGROUND OF THE INVENTION

Cleansing compositions are generally a single phase or an oily phase dispersed in a watery cleansing phase. When significant quantities of an oily phase are present, due to presence of lipophilic type components, substantial efforts are usually made to provide a stable emulsion, which does not come apart. However, there can be significant advantages to having two or more phases present in a single container during non-use. Said advantages can be either esthetical or functional when related to product efficiency or ingredients stability. These phases can be appealing to the eye depending upon various agents; particularly coloring agents dispersed therein or present at the interface of the phases. A small amount of shaking by the user prior to end use can create mixing of the phases and at times a bubbly-type appearance. Emulsion(s) can be formed during the mixing and can be present during the actual cleansing. Upon non-agitation, the phases once more readily separate into two or more phases and are ready for the next cleansing, for example, twenty-four hours later when using a hard surface cleaning composition. However, making two aqueous phases is not readily achievable.

SUMMARY OF THE INVENTION

The present invention relates to a two phase liquid cleaning composition containing a nonionic surfactant, a zwitterionic surfactant, and/or an anionic surfactant, a glycol ether, a solubilizing agent, a water insoluble inorganic compound, optionally, an acid and water.

DETAILED DESCRIPTION OF THE INVENTION

The present invention relates to a liquid cleaning composition which contains a lower aqueous phase and an upper oily phase, the lower aqueous phase and the upper oily phase are in a 40:60 to 95:5 ratio, wherein the liquid cleaning composition comprises approximately by weight:

(a) 0.1% to 10% of an ethoxylated nonionic surfactant, wherein 80% to 100% of said nonionic being in said upper oil phase and 0 to 20% of said nonionic surfactant being in said lower aqueous phase; or distributed between said upper and lower phase according to partition coefficient of the said ingredient;

(b) 0.1% to 5% of a second surfactant selected from the group consisting of zwitterionic surfactant and anionic surfactants and mixtures thereof, wherein 90% to 100% of said second surfactant being in said lower aqueous phase and 0 to 10% of said second surfactant being in said upper oily phase; or distributed between said upper and lower phase according to partition coefficient of the said ingredient;

(c) 0.1% to 10% of a water insoluble organic compound wherein at least 98% of said water insoluble organic compound is contained in said upper oily phase;

(d) 0.05% to 2% of a perfume, wherein at least 98% of said perfume is contained in said upper oily phase; or distributed between said upper and lower phase according to partition coefficient of the said ingredient;

(e) 0.1% to 10% of a solubilizing agent such as a $C_2$–$C_3$ alkanol, wherein 60% to 90% of said solubilizing agent being in said lower aqueous phase and 10% to 40% of said solubilizing agent being in said upper oily phase;

(f) 0.1% to 20% of a glycol ether, wherein 80% to 100% of said glycol ether being in said upper oily phase and 0 to 20% of said glycol ether being in said lower phase;

(g) 0 to 3% of an acid selected from the group consisting of an organic acid and an inorganic acid and mixtures thereof, wherein at least 90% of said acid being in said lower aqueous phase; and (h) 60% to 99.5% of water, said water being in said lower aqueous phase.

Excluded from the instant cleaning compositions are a hydrophilic polymer or copolymer selected from the group consisting of polyacrylate, polystyrene sulfonate, polyvinyl pyrrolidene or maleic anhydride and mixtures thereof.

The nonionic surfactant is present in amounts of about 0.1% to 10%, preferably 0.25% to 8% by weight of the composition and provides superior performance in the removal of oily soil.

The water soluble nonionic surfactants utilized in this invention are commercially well known and include the primary aliphatic alcohol ethoxylates, secondary aliphatic alcohol ethoxylates, alkylphenol ethoxylates and ethylene-oxide-propylene oxide condensates on primary alkanols, such a Plurafacs (BASF) and condensates of ethylene oxide with sorbitan fatty acid esters such as the Tweens (ICI). The nonionic synthetic organic detergents generally are the condensation products of an organic aliphatic or alkyl aromatic hydrophobic compound and hydrophilic ethylene oxide groups. Practically any hydrophobic compound having a carboxy, hydroxy, amido, or amino group with a free hydrogen attached to the nitrogen can be condensed with ethylene oxide or with the polyhydration product thereof, polyethylene glycol, to form a water-soluble nonionic detergent. Further, the length of the polyethenoxy chain can be adjusted to achieve the desired balance between the hydrophobic and hydrophilic elements.

The nonionic detergent class includes the condensation products of a higher alcohol (e.g., an alkanol containing about 8 to 18 carbon atoms in a straight or branched chain configuration) condensed with about 1 to 30 moles of ethylene oxide, for example, lauryl or myristyl alcohol condensed with about 16 moles of ethylene oxide (EO), tridecanol condensed with about 6 to moles of EO, myristyl alcohol condensed with about 10 moles of EO per mole of myristyl alcohol, the condensation product of EO with a cut of coconut fatty alcohol containing a mixture of fatty alcohols with alkyl chains varying from 10 to about 14 carbon atoms in length and wherein the condensate contains either about 6 moles of EO per mole of total alcohol or about 9 moles of EO per mole of alcohol and tallow alcohol ethoxylates containing 6 EO to 11 EO per mole of alcohol.

A preferred group of the foregoing nonionic surfactants are the Neodol ethoxylates (Shell Co.), which are higher aliphatic, primary alcohol containing about 9–15 carbon atoms, such as $C_9$–$C_{11}$ alkanol condensed with 2 to 10 moles of ethylene oxide (Neodol 91-2.5), $C_{12-13}$ alkanol condensed with 1.1 to 6.5 moles ethylene oxide (Neodol 23-2), $C_{12-15}$ alkanol condensed with 2.5 to 9 moles ethylene oxide (Neodol 25-3), $C_{14-15}$ alkanol condensed with 4 to 7 moles ethylene oxide (Neodol 45-4), and the like. Such ethoxamers have an HLB (hydrophobic lipophilic balance) value of about 6 to 15 and give good O/W emulsification.

Additional satisfactory alcohol ethylene oxide condensates are the condensation products of a secondary aliphatic alcohol containing 8 to 18 carbon atoms in a straight or branched chain configuration condensed with 1 to 30 moles of ethylene oxide. Examples of commercially available nonionic detergents of the foregoing type are $C_{11}$–$C_{15}$ secondary alkanol condensed with either 9 EO (Tergitol 15-S-9) or 12 EO (Tergitol 15-S-12) marketed by Union Carbide.

Other suitable nonionic detergents include the polyethylene oxide condensates of one mole of alkyl phenol containing from about 8 to 18 carbon atoms in a straight- or branched chain alkyl group with about 1 to 30 moles of ethylene oxide. Specific examples of alkyl phenol ethoxylates include nonyl phenol condensed with about 2–10 moles of EO per mole of nonyl phenol, dinonyl phenol condensed with about 2–12 moles of EO per mole of phenol, dinonyl phenol condensed with about 2–15 moles of EO per mole of phenol and di-isoctylphenol condensed with about 15 moles of EO per mole of phenol. Commercially available nonionic surfactants of this type include Igepal CO-630 (nonyl phenol ethoxylate) marketed by GAF Corporation.

Also among the satisfactory nonionic detergents are the condensation products of a $C_8$–$C_{20}$ alkanol with a heteric mixture of ethylene oxide and propylene oxide wherein the weight ratio of ethylene oxide to propylene oxide is from 2.5:1 to 4:1, preferably 2.8:1 to 3.3:1, with the total of the ethylene oxide and propylene oxide (including the terminal ethanol or propanol group) being from 60–85%, preferably 70–80%, by weight. Such detergents are commercially available from BASF-Wyandotte and a particularly preferred detergent is a $C_{10}$–$C_{16}$ alkanol condensate with ethylene oxide and propylene oxide, the weight ratio of ethylene oxide to propylene oxide being 3:1 and the total alkoxy content being about 70% by weight.

Condensates of 2 to 30 moles of ethylene oxide with sorbitan mono- and tri-$C_{10}$–$C_{20}$ alkanoic acid esters having a HLB of 6 to 15 also may be employed as the nonionic detergent ingredient in the described composition. These surfactants are well known and are available from Imperial Chemical Industries under the Tween trade name. Suitable surfactants include polyoxyethylene (4) sorbitan monolaurate, polyoxyethylene (4) sorbitan monostearate, polyoxyethylene (20) sorbitan trioleate and polyoxyethylene (20) sorbitan tristearate.

Other suitable nonionic detergents are marketed under the trade name "Pluronics." The compounds are formed by condensing ethylene oxide with a hydrophobic base formed by the condensation of propylene oxide with propylene glycol. The molecular weight of the hydrophobic portion of the molecule is of the order of 950 to 4000 and preferably 200 to 2,500. The addition of polyoxyethylene radicals to the hydrophobic portion tends to increase the solubility of the molecule as a whole so as to make the surfactant water-soluble. The molecular weight of the block polymers varies from 1,000 to 15,000 and the polyethylene oxide content may comprise 20% to 80% by weight. Preferably, these surfactants will be in liquid form and satisfactory surfactants are available as grades L 62 and L 64.

The anionic surfactants which may be used in the cleaning composition of this invention are water soluble and include the sodium, potassium, ammonium and ethanolammonium salts of linear $C_8$–$C_{16}$ alkyl benzene sulfonates; $C_{10}$–$C_{20}$ paraffin sulfonates, alpha olefin sulfonates containing about 10–24 carbon atoms, $C_8$–$C_{18}$ alkyl sulfates, and $C_8$–$C_{18}$ ethoxylated alkyl ether sulfate, and mixtures thereof. The preferred anionic sulfonate surfactant is a $C_{12-18}$ paraffin sulfonate present in the composition at a concentration of about 0.1 wt. % to 5 wt. %, more preferably 0.25 wt. % to 4 wt. %.

The paraffin sulfonates may be monosulfonates or di-sulfonates and usually are mixtures thereof, obtained by sulfonating paraffins of 10 to 20 carbon atoms. Preferred paraffin sulfonates are those of $C_{12-18}$ carbon atoms chains, and more preferably they are of $C_{14-17}$ chains. Paraffin sulfonates that have the sulfonate group(s) distributed along the paraffin chain are described in U.S. Pat. Nos. 2,503,280; 2,507,088; 3,260,744; and 3,372,188; and also in German Patent 735,096. Such compounds may be made to specifications and desirably the content of paraffin sulfonates outside the $C_{14-17}$ range will be minor and will be minimized, as will be any contents of di- or poly-sulfonates.

Examples of suitable other sulfonated anionic detergents are the well known higher alkyl mononuclear aromatic sulfonates, such as the higher alkylbenzene sulfonates containing 9 to 18 or preferably 9 to 16 carbon atoms in the higher alkyl group in a straight or branched chain, or $C_{8-15}$ alkyl toluene sulfonates. A preferred alkylbenzene sulfonate is a linear alkylbenzene sulfonate having a higher content of 3-phenyl (or higher) isomers and a correspondingly lower content (well below 50%) of 2-phenyl (or lower) isomers, such as those sulfonates wherein the benzene ring is attached mostly at the 3 or higher (for example 4, 5, 6 or 7) position of the alkyl group and the content of the isomers in which the benzene ring is attached in the 2 or 1 position is correspondingly low. Preferred materials are set forth in U.S. Pat. No. 3,320,174, especially those in which the alkyls are of 10 to 13 carbon atoms.

The $C_{8-18}$ ethoxylated alkyl ether sulfate surfactants have the structure $$R—(OCHCH_2)_nOSO_3^-M^+$$

wherein n is about 1 to about 22 more preferably 1 to 3 and R is an alkyl group having about 8 to about 18 carbon atoms, more preferably 12 to 15 and natural cuts, for example, $C_{12-14}$ or $C_{12-16}$ and M is an ammonium cation or a metal cation, most preferably sodium. The ethoxylated alkyl ether sulfate is present in the composition at a concentration of about 0.1 wt. % to about 5.0 wt. %, more preferably about 0.25 wt. % to 4.5 wt. %.

The ethoxylated alkyl ether sulfate may be made by sulfating the condensation product of ethylene oxide and $C_{8-10}$ alkanol, and neutralizing the resultant product. The ethoxylated alkyl ether sulfates differ from one another in the number of carbon atoms in the alcohols and in the number of moles of ethylene oxide reacted with one mole of such alcohol. Preferred ethoxylated alkyl ether polyethenoxy sulfates contain 12 to 15 carbon atoms in the alcohols and in the alkyl groups thereof, e.g., sodium myristyl (3 EO) sulfate.

Ethoxylated $C_{8-18}$ alkylphenyl ether sulfates containing from 2 to 6 moles of ethylene oxide in the molecule are also suitable for use in the invention compositions. These detergents can be prepared by reacting an alkyl phenol with 2 to 6 moles of ethylene oxide and sulfating and neutralizing the resultant ethoxylated alkylphenol.

The water-soluble zwitterionic surfactant (betaine), which may be used in the instant cleaning composition, constitutes about 0.1% to 5%, preferably 0.25% to 4%, by weight and provides good foaming properties and mildness to the composition. The zwitterionic surfactant is a water soluble betaine having the general formula:

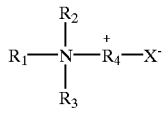

wherein $X^-$ is selected from the group consisting of $SO_3^-$ and $CO_2^-$ and $R_1$ is an alkyl group having 10 to about 20 carbon atoms, preferably 12 to 16 carbon atoms, or the amido radical:

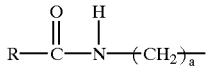

wherein R is an alkyl group having about 9 to 19 carbon atoms and a is the integer 1 to 4; $R_2$ and $R_3$ are each alkyl groups having 1 to 3 carbons and preferably 1 carbon; $R_4$ is an alkylene or hydroxyalkylene group having from 1 to 4 carbon atoms and, optionally, one hydroxyl group. Typical alkyldimethyl betaines include decyl dimethyl betaine or 2-(N-decyl-N,N-dimethyl-ammonia)acetate, coco dimethyl betaine or 2-(N-coco N,N-dimethylammonia)acetate, myristyl dimethyl betaine, palmityl dimethyl betaine, lauryl dimethyl betaine, cetyl dimethyl betaine, stearyl dimethyl betaine, etc. The amidobetaines similarly include cocoamidoethylbetaine, cocoamidopropyl betaine and the like. A preferred betaine is coco ($C_8$–$C_{18}$) amidopropyl dimethyl betaine.

The water insoluble organic compound is an insoluble saturated or unsaturated organic compounds contain 4 to 20 carbon atoms and up to 4 different or identical functional groups and is used at a concentration of about 0.1 wt. % to about 10 wt. %, more preferably about 0.25 wt. % to about 8 wt. %. Examples of acceptable water insoluble saturated or unsaturated organic compound include (but are not limited to) water insoluble hydrocarbons containing 0 to 4 different or identical functional groups, water insoluble aromatic hydrocarbons containing 0 to 4 different or identical functional groups, water insoluble heterocyclic compounds containing 0 to 4 different or identical functional groups, water insoluble ethers containing 0 to 3 different or identical functional groups, water insoluble alcohols containing 0 to 3 different or identical functional groups, water insoluble amines containing 0 to 3 different or identical functional groups, water insoluble esters containing 0 to 3 different or identical functional groups, water insoluble carboxylic acids containing 0 to 3 different or identical functional groups, water insoluble amides containing 0 to 3 different or identical functional groups, water insoluble nitrides containing 0 to 3 different or identical functional group, water insoluble aldehydes containing 0 to 3 different or identical functional groups, water insoluble ketones containing 0 to 3 different or identical functional groups, water insoluble phenois containing 0 to 3 different or identical functional groups, water insoluble nitro compounds containing 0 to 3 different or identical functional groups, water insoluble halogens containing 0 to 3 different or identical functional groups, water insoluble sulfates or sulfonates containing 0 to 3 different or identical functional groups, limonene, dipentene, terpineol, essential oils, perfumes, water insoluble organic compounds containing up to 4 different or identical functional groups such as an alkyl cyclohexane having both three hydroxys and one ester group and mixture thereof.

Typical heterocyclic compounds are 2,5-dimethylhydrofuran,2-methyl-1,3-dioxolane, 2-ethyl 2-methyl 1,3 dioxolane, 3-ethyl 4-propyl tetrahydropyran, 3-morpholino-1,2-propanediol and N-isopropyl morpholine A typical amine is alpha-methyl benzyldimethylamine. Typical halogens are 4-bromotoluene, butyl chloroform and methyl perchloropropane. Typical hydrocarbons are 1,3-dimethylcyclohexane, cyclohexyl-1 decane, methyl-3 cyclohexyl-9 nonane, methyl-3 cyclohexyl-6 nonane, dimethyl cycloheptane, trimethyl cyclopentane, ethyl-2 isopropyl-4 cyclohexane. Typical aromatic hydrocarbons are bromotoluene, diethyl benzene, cyclohexyl bromoxylene, ethyl-3 pentyl-4 toluene, tetrahydronaphthalene, nitrobenzene and methyl naphthalene. Typical water insoluble esters are benzyl acetate, dicyclopentadienylacetate, isononyl acetate, isobornyl acetate and isobutyl isobutyrate. Typical water insoluble ethers are di(alphamethyl benzyl)ether and diphenyl ether. Typical alcohols are phenoxyethanol and 3-morpholino-1,2-propanediol. Typical water insoluble nitro derivatives are nitro butane and nitrobenzene.

Suitable essential oils are selected from the group consisting of: Anethole 20/21 natural, Aniseed oil china star, Aniseed oil globe brand, Balsam (Peru), Basil oil (India), Black pepper oil, Black pepper oleoresin 40/20, Bois de Rose (Brazil) FOB, Borneol Flakes (China), Camphor oil, White, Camphor powder synthetic technical, Cananga oil (Java), Cardamom oil, Cassia oil (China), Cedarwood oil (China) BP, Cinnamon bark oil, Cinnamon leaf oil, Citronella oil, Clove bud oil, Clove leaf, Coriander (Russia), Coumarin 69° C. (China), Cyclamen Aldehyde, Diphenyl oxide, Ethyl vanilin, Eucalyptol, Eucalyptus oil, Eucalyptus citriodora, Fennel oil, Geranium oil, Ginger oil, Ginger oleoresin (India), White grapefruit oil, Guaiacwood oil, Gurjun balsam, Heliotropin, Isobornyl acetate, Isolongifolene, Juniper berry oil, L-methyl acetate, Lavender oil, Lemon oil, Lemongrass oil, Lime oil distilled, Litsea Cubeba oil, Longifolene, Menthol crystals, Methyl cedryl ketone, Methyl chavicol, Methyl salicylate, Musk ambrette, Musk ketone, Musk xylol, Nutmeg oil, Orange oil, Patchouli oil, Peppermint oil, Phenyl ethyl alcohol, Pimento berry oil, Pimento leaf oil, Rosalin, Sandalwood oil, Sandenol, Sage oil, Clary sage, Sassafras oil, Spearmint oil, Spike lavender, Tagetes, Tea tree oil, Vanilin, Vetyver oil (Java), Wintergreen, Allocimene, Arbanex™, Arbanol®, Bergamot oils, Camphene, Alpha-Campholenic aldehyde, I-Carvone, Cineoles, Citral, Citronellol Terpenes, Alpha-Citronellol, Citronellyl Acetate, Citronellyl Nitrile, Para-Cymene, Dihydroanethole, Dihydrocarveol, d-Dihydrocarvone, Dihydrolinalool, Dihydromyrcene, Dihydromyrcenol, Dihydromyrcenyl Acetate, Dihydroterpineol, Dimethyloctanal, Dimethyloctanol, Dimethyloctanyl Acetate, Estragole, Ethyl-2 Methylbutyrate, Fenchol, Fernlol™, Florilys™, Geraniol, Geranyl Acetate, Geranyl Nitrile, Glidmint™ Mint oils, Glidox™, Grapefruit oils, trans-2-Hexenal, trans-2-Hexenol, cis-3-Hexenyl Isovalerate, cis-3-Hexanyl-2-methylbutyrate, Hexyl Isovalerate, Hexyl-2-methylbutyrate, Hydroxycitronellal, Ionone, Isobornyl Methylether, Linalool, Linalool Oxide, Linalyl Acetate, Menthane Hydroperoxide, I-Methyl Acetate, Methyl Hexyl Ether, Methyl-2-methylbutyrate, 2-Methylbutyl Isovalerate, Myrcene, Nerol, Neryl Acetate, 3-Octanol, 3-Octyl Acetate, Phenyl Ethyl-2-methylbutyrate, Petitgrain oil, cis-Pinane, Pinane Hydroperoxide, Pinanol, Pine Ester, Pine Needle oils, Pine oil, alpha-Pinene, beta-Pinene, alpha-Pinene Oxide, Plinol, Plinyl Acetate, Pseudo Ionone, Rhodinol, Rhodinyl Acetate, Spice oils, alpha-Terpinene, gamma-Terpinene, Terpinene-4-OL, Terpineol, Terpinolene, Terpinyl Acetate, Tetrahydrolinalool, Tetrahydrolinalyl Acetate, Tetrahydromyrcenol, Tetralol®, Tomato oils, Vitalizair, Zestoral™.

Especially preferred water insoluble organic compounds are water insoluble saturated organic monoesters and diesters and mixtures thereof.

The organic monoesters have the formula:

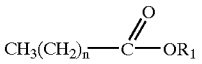

wherein $R_1$ is an alkyl group having 2 to 10 carbon atoms and n is a number from 4 to 16.

Preferred monoesters are isopropyl palmitate and isopropyl myristate.

The organic diesters having the formula:

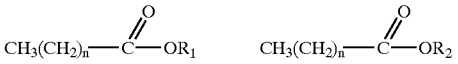

wherein $R_1$ and $R_2$ are independently a $C_2$ to $C_6$ alkyl group and n is a number from 4 to 16. A preferred organic diester is dibutyl adipate.

Another preferred water insoluble ester is tributyl citrate.

Useful water insoluble hydrocarbons are liquid paraffins ($C_{11}$–$C_{18}$) and Isoparaffins. Commercially available Isoparaffins of this type include Isopar H.

The instant compositions contain about 0.1 wt. % to about 10 wt. %, more preferably about 0.25 wt. % to about 8 wt. %, of at least one solubilizing agent which is a $C_{2-5}$, preferably $C_2$–$C_3$ mono, dihydroxy or polyhydroxy alkanols such as ethanol, isopropanol, glycerol ethylene glycol, diethylene glycol and propylene glycol and mixtures thereof.

The glycol ether which is present at a concentration of 0.1 wt. % to 20 wt. %, more preferably 0.25 wt. % to 15 wt. % selected from the group consisting of mono and di $C_1$–$C_6$ alkyl ethers of ethylene glycol and propylene glycol having the structural formulas $R(X)_nOH$, $R(X)_nOR$ and $R_1(X)_nOR_1$ wherein R is $C_1$–$C_6$ alkyl group, $R_1$ is $C_2$–$C_4$ acyl group, X is ($OCH_2CH_2$) or ($OCH_2(CH_3)CH$) and n is a number from 1 to 4, diethylene glycol, triethylene glycol, an alkyl lactate, wherein the alkyl group has 1 to 6 carbon atoms, 1 methoxy-2-propanol, 1 methoxy-3-propanol, and 1 methoxy 2-, 3- or 4-butanol.

Representative members of the polypropylene glycol include dipropylene glycol and polypropylene glycol having a molecular weight of 150 to 1000, e.g., polypropylene glycol 400. Other satisfactory glycol ethers are ethylene glycol monobutyl ether (butyl cellosolve), diethylene glycol monobutyl ether (butyl carbitol), triethylene glycol monobutyl ether, mono, di, tri propylene glycol monobutyl ether, tetraethylene glycol monobutyl ether, mono, di, tripropylene glycol monomethyl ether, propylene glycol monomethyl ether, ethylene glycol monohexyl ether, diethylene glycol monohexyl ether, propylene glycol tertiary butyl ether, ethylene glycol monoethyl ether, ethylene glycol monomethyl ether, ethylene glycol monopropyl ether, ethylene glycol monopentyl ether, diethylene glycol monomethyl ether, diethylene glycol monoethyl ether, diethylene glycol monopropyl ether, diethylene glycol monopentyl ether, triethylene glycol monomethyl ether, triethylene glycol monoethyl ether, triethylene glycol monopropyl ether, triethylene glycol monopentyl ether, triethylene glycol monohexyl ether, mono, di, tripropylene glycol monoethyl ether, mono, di tripropylene glycol monopropyl ether, mono, di, tripropylene glycol monopentyl ether, mono, di, tripropylene glycol monohexyl ether, mono, di, tributylene glycol mono methyl ether, mono, di, tributylene glycol monoethyl ether, mono, di, tributylene glycol monopropyl ether, mono, di, tributylene glycol monobutyl ether, mono, di, tributylene glycol monopentyl ether and mono, di, tributylene glycol monohexyl ether, ethylene glycol monoacetate and dipropylene glycol propionate. Preferred glycol ethers are propylene glycol monobutyl ether and dipropyl glycol butyl ether.

The acid used in the instant composition at a concentration of 0 to 3 wt. %, preferably 0.1 wt. % to 3 wt. % is selected from the group consisting of organic acids and inorganic acids and mixtures thereof. The organic acids are selected from the group consisting of $C_4$–$C_8$ mono- and di-aliphatic carboxylic acids and hydroxy containing organic acids and mixtures thereof. Typical organic acids are adipic acid, succinic acid, latic acid, glycolic acid, salicylic acid, tartaric acid and ortho hydroxy benzoic acid. Typical inorganic acids are sulfuric acid, nitric acid and hydrochloric acid.

The cleaning composition of this invention may, if desired, also contain other components either to provide additional effect or to make the product more attractive to the consumer. The following are mentioned by way of example: Colors or dyes such water soluble dye and oil/fat soluble dye or mixtures thereof in amounts up to 0.5% by weight; bactericides in amounts up to 1% by weight; preservatives or antioxidizing agents, such as formalin, 5-bromo-5-nitro-dioxan-1,3; 5-chloro-2-methyl-4-isothaliazolin-3-one, 2,6-di-tert.butyl-p-cresol, etc., in amounts up to 2% by weight; and pH adjusting agents, such as sulfuric acid or sodium hydroxide, as needed. The composition contains 0.05 wt. % to 2 wt. %, more preferably 0.1 wt. % to 1 wt. % of a perfume.

The final essential ingredient in the cleaning compositions is water. The proportion of water in the cleaning compositions generally is in the range of 60% to 99.5%, preferably 70% to 95% by weight of the cleaning composition.

In final form, the instant two phase compositions exhibit stability at reduced and increased temperatures. More specifically, such compositions remain clear and stable in the range of 0° C. to 50° C., especially 4° C. to 43° C. Such compositions exhibit a pH of 3 to 7.0. The liquid compositions are readily pourable and exhibit a viscosity in the range of 6 to 1000 millipascal. second (mPas.) as measured at 25° C. with a Brookfield RVT Viscometer using a #2 spindle rotating at 50 rpm.

The instant compositions explicitly exclude alkali metal silicates and alkali metal builders such as alkali metal polyphosphates, alkali metal carbonates, alkali metal phosphonates and alkali metal citrates because these materials, if used in the instant composition, would cause the composition to have a high pH as well as leaving residue on the surface being cleaned.

The following examples illustrate liquid cleaning compositions of the described invention. Unless otherwise specified, all percentages are by weight. The exemplified compositions are illustrative only and do not limit the scope of the invention. Unless otherwise specified, the proportions in the examples and elsewhere in the specification are by weight.

EXAMPLE 1

The following compositions in wt. % were prepared by simple mixing procedure:

| | 1 | 2 | 3 | 4 | 5 | 6 |
|---|---|---|---|---|---|---|
| Dobanol 91/25 | 3 | | | 1.5 | 1.5 | 3 |
| Dobanol 91/5 | | 3 | | 1.5 | | |

-continued

| | | | | | | |
|---|---|---|---|---|---|---|
| Dobanol 91/8 | | | 3 | | 1.5 | |
| Cocoamido propyl dimethyl betaine (30%) | 3 | 3 | 3 | 3 | 3 | 3 |
| Isopropanol | 2 | 2 | 2 | 2 | 2 | 2 |
| Ethanol | | | | | | |
| Propylene glycol monobutyl ether | 3 | 3 | 3 | 3 | 3 | |
| Dipropylene glycol monobutyl ether | | | | | | 3 |
| Isopar H | 5 | 5 | 5 | 5 | 5 | 5 |
| Normal paraffin liquid C11–C18 | | | | | | |
| Isopropyl myristate | | | | | | |
| Dibutyl adipate | | | | | | |
| Perfume | 0.3 | 0.3 | 0.3 | 0.3 | 0.3 | 0.3 |
| Water | 83.7 | 83.7 | 83.7 | 83.7 | 83.7 | 83.7 |
| pH | 5.65 | 5.61 | 5.45 | 5.6 | 5.53 | 5.64 |
| % upper layer | 22 | 8 | 10 | | 6.7 | 25 |
| % lower layer | 78 | 92 | 90 | | 93.3 | 75 |

| | 7 | 8 | 9 | 10 | 11 |
|---|---|---|---|---|---|
| Dobanol 91/25 | | | 1.5 | 1.5 | 3 |
| Dobanol 91/5 | 3 | | 1.5 | | |
| Dobanol 91/8 | | 3 | | 1.5 | |
| Cocoamido propyl dimethyl betaine (30%) | 3 | 3 | 3 | 3 | 3 |
| Isopropanol | 2 | 2 | 2 | 2 | 2 |
| Ethanol | | | | | |
| Propylene glycol monobutyl ether | | | | | 3 |
| Dipropylene glycol monobutyl ether | 3 | 3 | 3 | 3 | |
| Isopar H | 5 | 5 | 5 | 5 | |
| Normal paraffin liquid C11–C18 | | | | | 5 |
| Isopropyl myristate | | | | | |
| Dibutyl adipate | | | | | |
| Perfume | 0.3 | 0.3 | 0.3 | 0.3 | 0.3 |
| Water | 83.7 | 83.7 | 83.7 | 83.7 | 83.7 |
| pH | 5.6 | 5.44 | 5.61 | 5.55 | 5.61 |
| % upper layer | 8 | 8 | | 6.7 | 30 |
| % lower layer | 92 | 92 | | 93.3 | 70 |

| | 12 | 13 | 14 | 15 | 16 | 17 |
|---|---|---|---|---|---|---|
| Dobanol 91/25 | | | 1.5 | 1.5 | 3 | |
| Dobanol 91/5 | 3 | | 1.5 | | | 3 |
| Dobanol 91/8 | | 3 | | 1.5 | | |
| Cocoamido propyl dimethyl betaine (30%) | 3 | 3 | 3 | 3 | 3 | 3 |
| Isopropanol | 2 | 2 | 2 | 2 | 2 | 2 |
| Ethanol | | | | | | |
| Propylene glycol monobutyl ether | 3 | 3 | 3 | 3 | | |
| Dipropylene glycol monobutyl ether | | | | | 3 | 3 |
| Isopar H | | | | | | |
| Normal paraffin liquid C11–C18 | 5 | 5 | 5 | 5 | 5 | 5 |
| Isopropyl myristate | | | | | | |
| Dibutyl adipate | | | | | | |
| Perfume | 0.3 | 0.3 | 0.3 | 0.3 | 0.3 | 0.3 |
| Water | 83.7 | 83.7 | 83.7 | 83.7 | 83.7 | 83.7 |
| pH | 5.57 | 5.43 | 5.59 | 5.52 | 5.63 | 5.58 |
| % upper layer | 8 | 8 | 5.7 | 8 | 33.3 | 6.7 |
| % lower layer | 92 | 92 | 93.3 | 92 | 66.7 | 93.3 |

| | 18 | 19 | 20 | 21 | 22 |
|---|---|---|---|---|---|
| Dobanol 91/25 | | 1.5 | 1.5 | 3 | |
| Dobanol 91/5 | | 1.5 | | | 3 |
| Dobanol 91/8 | 3 | | 1.5 | | |
| Cocoamido propyl dimethyl betaine (30%) | 3 | 3 | 3 | 3 | 3 |
| Isopropanol | 2 | 2 | 2 | | 2 |
| Ethanol | | | | 4 | |
| Propylene glycol monobutyl ether | | | | 3 | 3 |

-continued

| | | | | | |
|---|---|---|---|---|---|
| Dipropylene glycol monobutyl ether | 3 | 3 | 3 | | |
| Isopar H | | | | 2.5 | 2.5 |
| Normal paraffin liquid C11–C18 | 5 | 5 | 5 | | |
| Isopropyl myristate | | | | | |
| Dibutyl adipate | | | | | |
| Perfume | 0.3 | 0.3 | 0.3 | 0.3 | 0.3 |
| Water | 83.7 | 83.7 | 83.7 | 83.7 | 83.7 |
| pH | 5.44 | 5.6 | 5.53 | 5.66 | 5.62 |
| % upper layer | 8 | 5 | 6.7 | 23.3 | 8 |
| % lower layer | 92 | 95 | 93.3 | 76.7 | 92 |

| | 23 | 24 | 25 | 26 | 27 | 28 |
|---|---|---|---|---|---|---|
| Dobanol 91/25 | | 1.5 | 1.5 | 3 | | |
| Dobanol 91/5 | | 1.5 | | | 3 | |
| Dobanol 91/8 | 3 | | 1.5 | | | 3 |
| Cocoamido propyl dimethyl betaine (30%) | 3 | 3 | 3 | 3 | 3 | 3 |
| Isopropanol | 2 | 2 | 2 | 2 | 2 | 2 |
| Ethanol | | | | | | |
| Propylene glycol monobutyl ether | 3 | 3 | 3 | | | |
| Dipropylene glycol monobutyl ether | | | | 3 | 3 | 3 |
| Isopar H | 2.5 | 2.5 | 2.5 | 2.5 | 2.5 | 2.5 |
| Normal paraffin liquid C11–C18 | | | | | | |
| Isopropyl myristate | 2.5 | 2.5 | 2.5 | 2.5 | 2.5 | 2.5 |
| Dibutyl adipate | | | | | | |
| Perfume | 0.3 | 0.3 | 0.3 | 0.3 | 0.3 | 0.3 |
| Water | 83.7 | 83.7 | 83.7 | 83.7 | 83.7 | 83.7 |
| pH | 5.46 | 5.64 | 5.59 | 5.72 | 5.6 | 5.44 |
| % upper layer | 10 | 5 | 8 | 28.3 | 8 | 8 |
| % lower layer | 90 | 95 | 92 | 71.7 | 92 | 92 |

| | 29 | 30 | 31 | 32 | 33 | 34 |
|---|---|---|---|---|---|---|
| Dobanol 91/25 | 1.5 | 1.5 | 3 | | | 1.5 |
| Dobanol 91/5 | 1.5 | | | 3 | | 1.5 |
| Dobanol 91/8 | | 1.5 | | | 3 | |
| Cocoamido propyl dimethyl betaine (30%) | 3 | 3 | 3 | 3 | 3 | 3 |
| Isopropanol | 2 | 2 | | 2 | 2 | 2 |
| Ethanol | | | 4 | | | |
| Propylene glycol monobutyl ether | | | 3 | 3 | 3 | 3 |
| Dipropylene glycol monobutyl ether | 3 | 3 | | | | |
| Isopar H | 2.5 | 2.5 | 2.5 | 2.5 | 2.5 | 2.5 |
| Normal paraffin liquid C11–C18 | | | | | | |
| Isopropyl myristate | 2.5 | 2.5 | | | | |
| Dibutyl adipate | | | 2.5 | 2.5 | 2.5 | 2.5 |
| Perfume | 0.3 | 0.3 | 0.3 | 0.3 | 0.3 | 0.3 |
| Water | 83.7 | 83.7 | 83.7 | 83.7 | 83.7 | 83.7 |
| pH | 5.61 | 5.53 | 5.56 | 5.5 | 5.39 | 5.55 |
| % upper layer | 6.7 | 8 | 25 | 6.7 | 8 | 6.7 |
| % lower layer | 93.3 | 92 | 75 | 93.3 | 92 | 93.3 |

| | 35 | 36 | 37 | 38 |
|---|---|---|---|---|
| Dobanol 91/25 | 1.5 | 3 | | |
| Dobanol 91/5 | | | 3 | |
| Dobanol 91/8 | 1.5 | | 3 | |
| Cocoamido propyl dimethyl betaine (30%) | 3 | 3 | 3 | 3 |
| Isopropanol | 2 | 2 | 2 | 2 |
| Ethanol | | | | |
| Propylene glycol monobutyl ether | 3 | | | |
| Dipropylene glycol monobutyl ether | | 3 | 3 | 3 |
| Isopar H | 2.5 | 2.5 | 2.5 | 2.5 |
| Normal paraffin liquid C11–C18 | | | | |
| Isopropyl myristate | | | | |
| Dibutyl adipate | 2.5 | 2.5 | 2.5 | 2.5 |

-continued

| | | | | |
|---|---|---|---|---|
| Perfume | 0.3 | 0.3 | 0.3 | 0.3 |
| Water | 83.7 | 83.7 | 83.7 | 83.7 |
| pH | 5.49 | 5.59 | 5.37 | 5.43 |
| % upper layer | 8 | 38.3 | 8 | 8 |
| % lower layer | 92 | 61.7 | 92 | 92 |

What is claimed:

1. A liquid cleaning composition which contains a lower aqueous phase and an upper oily phase, wherein the liquid cleaning composition comprises approximately by weight:

(a) 0. 1% to 10% of an ethoxylated nonionic surfactant, wherein 80% to 100% of said nonionic being in said upper oil phase and 0 to 20% of said nonionic surfactant being in said lower aqueous phase; or distributed between said upper and lower phase according to partition coefficient of the nonionic surfactant;

(b) 0.1% to 5% of a second surfactant which is a zwitterionic surfactant, wherein 90% to 100% of said second surfactant being in said lower aqueous phase and 0 to 10% of said second surfactant being in said upper oily phase; or distributed between said upper and lower phase according to partition coefficient of said second surfactant;

(c) 0.1% to 10% of a water insoluble organic compound wherein at least 98% of said water insoluble organic compound is contained in said upper oily phase;

(d) 0.05% to 2% of a perfume, wherein at least 98% of said perfume is contained in said upper oily phase; or distributed between said upper and lower phase according to partition coefficient of said perfume;

(e) 0.1% to 10% of a solubilizing agent, wherein 60% to 90% of said solubilizing agent being in said lower aqueous phase and 10% to 40% of said solubilizing agent being in said upper oily phase;

(f) 0.1% to 20% of a glycol ether, wherein 80% to 100% of said glycol ether being in said upper oily phase and 0 to 20% of said glycol ether being in said lower phase;

(g) 0 to 3% of an acid selected from the group consisting of an organic acid and an inorganic acid and mixtures thereof, wherein at least 90% of said acid being in said lower aqueous phase; and (h) 60% to 99.5% of water, said water being in said lower aqueous phase.

2. The composition of claim 1, wherein said zwitterionic surfactant is cocoamidopropyl dimethyl betaine.

3. The composition of claim 1, wherein said second surfactant is said anionic surfactant.

4. The composition of claim 3, wherein said anionic surfactant is selected from the group consisting of sulfate surfactants and sulfonate surfactants.

5. The composition of claim 1, wherein said water insoluble organic compound is selected from the group consisting of isoparaffin, normal liquid paraffin ($C_{11}$–$C_{18}$), organic monoesters and organic diesters and mixtures thereof.

6. The composition of claim 1, wherein said solubilizing agent is a $C_2$–$C_3$ alkanol.

7. The composition of claim 1, wherein the glycol ether is selected from the group consisting of ethylene glycol monobutylether, diethylene glycol monobutyl ether, triethylene glycol monobutylether, propylene glycol tert-butyl ether, and mono-, di-, tri-propylene glycol monobutyl ether and mixtures thereof.

8. The microemulsion composition of claim 7, wherein the glycol ether is propylene glycol monobutyl ether or dipropylene glycol monobutyl ether.

9. The microemulsion composition of claim 1, wherein said acid is an aliphatic carboxylic acid selected from the group consisting of acrylic acid, propionic acid, glutaric acid, mixtures of glutaric acid and succinic acid, and adipic acid and mixtures of any of the foregoing.

10. The composition of claim 1, wherein said acid is an organic acid.

11. The composition of claim 1, wherein said acid is a hydroxy containing organic acid.

12. The composition of claim 11, wherein said hydroxy containing organic acid is lactic acid.

13. The composition of claim 11, wherein said hydroxy containing organic acid is citric acid.

* * * * *